United States Patent [19]

Crossmore, Jr.

[11] Patent Number: 4,574,045

[45] Date of Patent: Mar. 4, 1986

[54] REMOVAL OF UNDESIRABLE SUBSTANCES FROM FINELY DIVIDED PARTICLES

[76] Inventor: Edward Y. Crossmore, Jr., Box 201, New Bethlehem, Pa. 16242

[21] Appl. No.: 649,147

[22] Filed: Sep. 10, 1984

Related U.S. Application Data

[63] Continuation of Ser. No. 350,888, Feb. 22, 1982, abandoned.

[51] Int. Cl.[4] ..... B07B 9/02

[52] U.S. Cl. ..... 209/11; 209/12; 209/142; 209/144; 44/1 SR; 44/26; 34/10; 34/57 R

[58] Field of Search ..... 209/142–144, 209/11, 2, 12; 44/1 SR, 10 R, 26; 34/10, 57 R

[56] References Cited

U.S. PATENT DOCUMENTS

| | | | |
|---|---|---|---|
| 1,850,756 | 3/1932 | Lessing | 209/142 |
| 2,381,954 | 8/1945 | Hardinge | 209/144 |
| 2,502,916 | 4/1950 | Bar | 209/144 X |
| 2,696,911 | 12/1954 | Umney | 209/142 |
| 2,830,162 | 9/1958 | Widmer | 209/143 |
| 2,956,347 | 10/1960 | Gordon | 209/11 X |
| 3,878,091 | 4/1975 | Hukki | 209/143 |
| 3,977,892 | 8/1976 | Crossmore | 106/288 B |
| 4,159,942 | 7/1979 | Greer et al. | 209/143 |
| 4,222,858 | 9/1980 | Avila et al. | 209/143 X |
| 4,226,601 | 10/1980 | Smith | 44/1 SR |

FOREIGN PATENT DOCUMENTS

| | | | |
|---|---|---|---|
| 222471 | 7/1962 | Austria | 209/144 |
| 121041 | 11/1927 | Switzerland | 209/143 |
| 85 | of 1885 | United Kingdom | 209/144 |

*Primary Examiner*—Frank W. Lutter
*Assistant Examiner*—Wm. Bond
*Attorney, Agent, or Firm*—Larson and Taylor

[57] ABSTRACT

Substance particulate in the general size range of minus 30 Mesh U.S. Standard to about 1 micron is separated into portions based on the densities of those components making up the total by drying to about 1% moisture and air conveying the substance through a duct in which the material assumes a stratified arrangement dictated by particle density. Means are provided by air duct configuration and partial flow diversion to remove appropriate laminar segments of the air-solids mixture.

Light, medium and heavy ash and pyritic Sulfur in substantial percentages can be removed from bituminous coal fines embodying this principle in a negative air atmosphere. After beneficiation of bituminous coal fines any undesired pyritic or organic Sulfur can be contained by intimately mixing calcium hydroxide with the coal in the amount of 2.24 parts of calcium hydroxide to one (1) part of Sulfur by weight. Approximately 4½% ash by weight will be generated for each 1% elemental Sulphur contained from the fine coal particulate upon heating and combustion.

16 Claims, 4 Drawing Figures

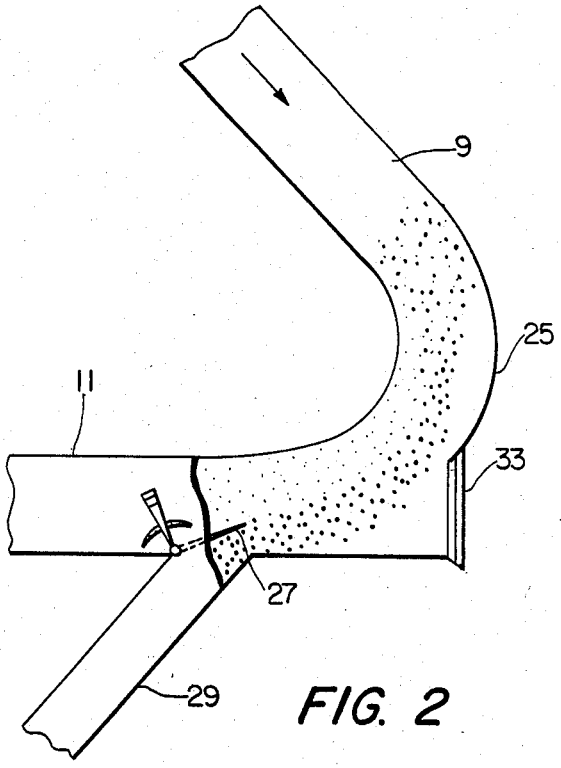
FIG. 2
FIG. 3
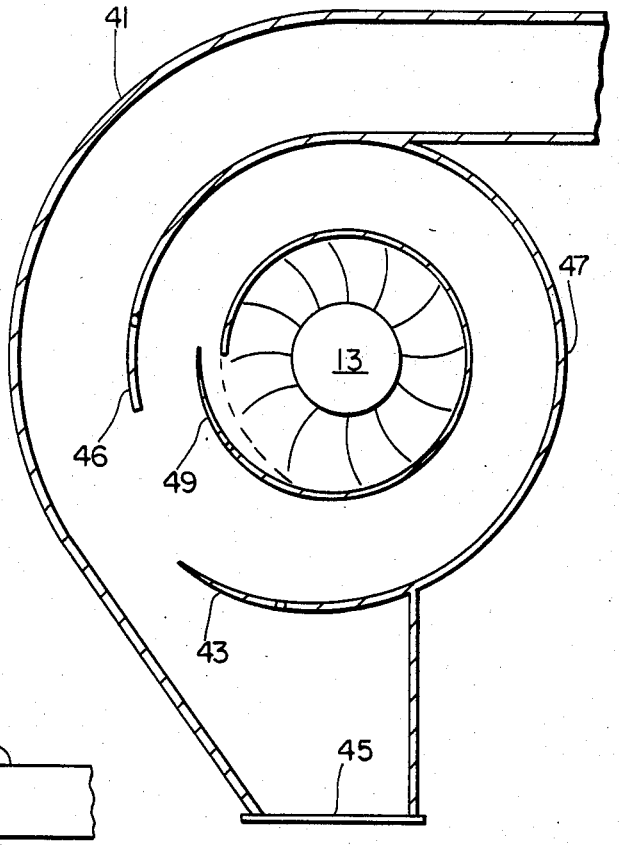
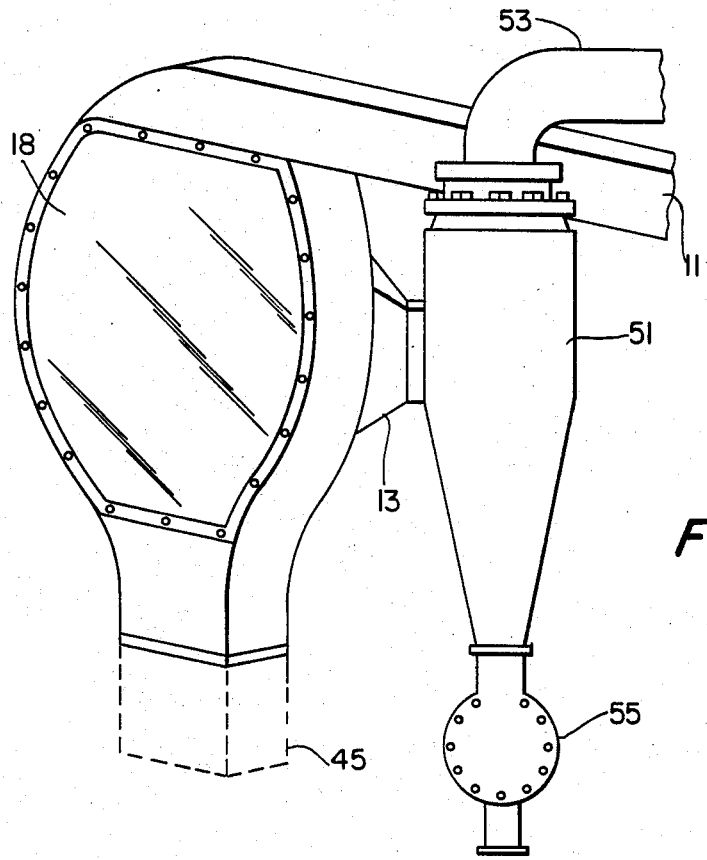
FIG. 4

REMOVAL OF UNDESIRABLE SUBSTANCES FROM FINELY DIVIDED PARTICLES

This application is a continuation of application Ser. No. 350,888 filed Feb. 22, 1982, now abandoned.

BACKGROUND OF THE INVENTION

1. Field of the Invention

This invention is directed to a method and apparatus for the production of useful materials from fine particulate substances whose components include matter deemed undesirable in the final product.

2. Description of the Prior Art

Practically all natural materials contained in the earth's crust which have proven beneficial to mankind exist in less than the pure or desired state so means have been developed over the years to retrieve the wanted substance. Examples are: fractional distillation of crude oil; smelting of ores; selecting, crushing and screening of minerals; washing of sand; and some of the newer flotation techniques where desirable elements are brought to the top of a bath vessel and skimmed from the surface. Most of the physical processes require preparation of one sort or another to obtain a generally suitable size consist which will favor separation of fractions based on the weight of the fraction component particles. In short, we concern ourselves with substance specific gravity or its relationship to the weight of water in a one cubic foot volume which is 62.4 pounds. The closer the size similarity among different substances, the more pronounced will be the effect of specific gravity or different substance particle weight in any separation attempt. To further early substance separation "sharpness", it was found agitation of the bath was helpful. A crude example is panning for gold where silt and sand can be kept in a water suspension in the much heavier precious metal sinks. The bath is poured off leaving the gold in the pan. The next step was to increase the specific gravity of the bath by means of sand, clay, calcium chloride and the present generally used magnetite additions. This permitted accurate control of the amount of unwanted material contained in a unit of desired substance. Generally speaking, this is the present condition of large commercial beneficiation installations today. Various devices such as dense medium vessels, water cyclones and froth flotation cells are innovations and all embody one or more of the aforementioned basic principles in the physical beneficiation of natural materials processes.

Past exploitation of saleable earth extractions proved successful generally when the initial deposit was of good quality as improvement techniques were crude; hand mining and only being paid for quality material; picking tables and belts for visual and physical rejection of unwanted material and what seemed to be an endless reserve of raw material. Consequently, a great deal of easily extractable ores, coal, masonry rock and amorphous substances, all of the highest quality, were removed. The advent of mechanical extraction, which is nonselective produces undesirable material along with the desired. Environmental mandates now place constraints as to subsequent consumption of many substances, the result of which is many basic industries concerned with the extraction of natural resources find their present posture somewhat uncomfortable.

One objective of this invention concerns itself, but is not limited to, the beneficiation of bituminous coal. Coal extraction is a specific example of the brief description of a basic natural resource industry which is considered vital to the national interest, but is hampered in its functioning as such because of a combination of circumstances which would seem insurmountable at this writing. When one winnows and sifts the millions of words written and spoken as to coal utilization in the United States today and why it is not solving our national energy oil dependence there is but one answer, sulfur dioxide in the combustion emmissions. The allowable amount is 1.2 pounds of $SO_2$ per million btus., of coal combusted which translates to about 0.5 of 1% of elemental sulfur by weight, per ton of coal. The Sulfur mainly is contained as a component of iron pyrites and also as an organic substance within the coal structure. One objective of this invention is removal of pyritic Sulfur during coal preparation and containment of $SO_2$ emissions during the coal subsequent heating and combustion.

SUMMARY OF THE INVENTION

These and other objects of the invention are obtained by separating an admixture of solid particulate substances into its heavy weight, middle weight and light weight components by (i) drying said admixture of solid particles reduced to a mesh size of minus 30 to minus 250 to remove surface moisture therefrom, (ii) drawing a conveying gas through a closed separation system comprising a series of three separation stages all in communication with each other, (iii) passing said conveying gas with said dried admixture of particles to said first separation stage where the dried particles are passed through first a first elbow-shaped duct wherein heavy weight particles are separated from the remaining middle weight and light weight particles by centripetal force induced therein and split away from said remaining particles by a first adjustable splitting means, (iv) passing the remaining middle weight and light weight particles to said second separation step where the particles are passed over a second elbow-shaped duct wherein medium weight particles are separated from the remaining particles by centripetal force induced therein and split away therefrom by a second adjustable splitting means, (v) passing the remaining particles to said third separation stage comprising a cyclone separator wherein light weight particles are separated as cyclone overflow from remaining middle weight particles separated as cyclone underflow.

In a preferred aspect of the invention, the remaining particles after the separation effected in step iii above are passed directly into a circular duct in which a centrifigal force is induced to separate medium weight particles not separated in the second separation.

Another embodiment of the invention comprises mixing coal particles recovered by the method of the invention with particles of alkali metal hydroxide such as calcium hydroxide of substantially the same size as the recovered coal particles and agglomerating the mixture as by pelleting or briquetting. The result is a combustible article of manufacture substantially reduced in pyritic sulfur content whose total sulfur content is substantially converted to ash upon burning.

BRIEF DESCRIPTION OF THE DRAWINGS

A better understanding of the present invention may be had by reference to the following detailed description of the preferred embodiments thereof taken in connection with the accompanying drawings wherein:

FIG. 2 is an enlarged diagrammatic sectional view of the apparatus of the first separation stage of the invention;

FIG. 3 is an enlarged sectional view of the apparatus of the second separation stage of the invention; and FIG. 4 is an enlarged perspective view of the apparatuses of the second and third separation stages of the invention.

DETAILED DESCRIPTION OF A PREFERRED EMBODIMENT

Figure 1:
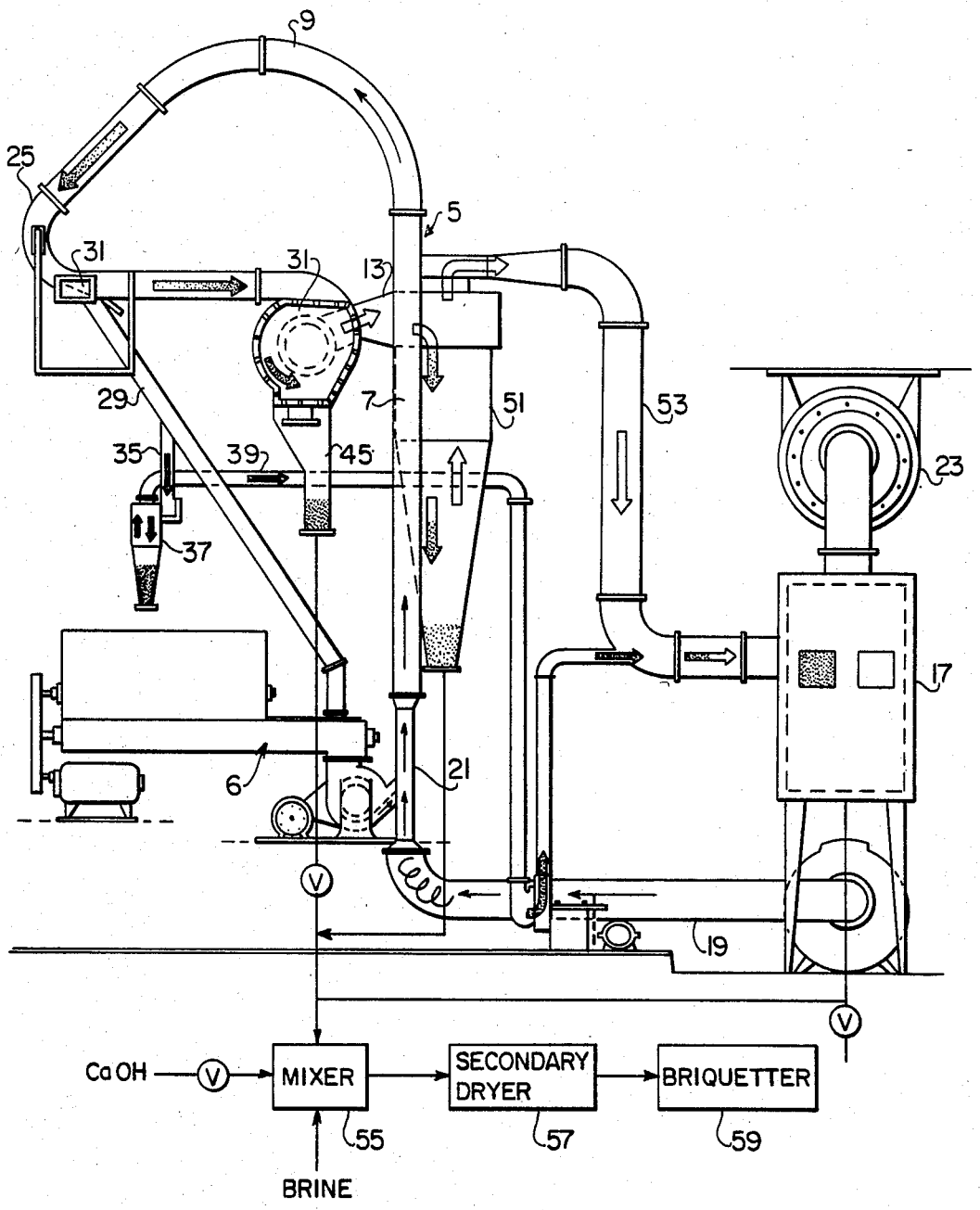
FIG. 1 is a diagrammatic representation of the apparatus of the invention used to effect the separations.

Referring to the drawings, a drying duct indicated generally as 5, comprised of an elongated straight section 7 and a curved section 9 communicates with a first separation stage I. First separation stage I communicates with a second separation stage II via duct 11 and the second separation stage II communicates via duct 13 with separation stage III. Stage III is connected by duct 53 to a dust collector 17. A heated conveying gas such as hot air is fed via conduit 19 into entry tube 21 of narrower diameter and pulled through the closed system by a fan 23 which induces a vacuum of 20 to 35, preferably about 28 inches water gauge. Thus, the flow rate of the heated conveying gas falls in the range of approximately 4000 to 5000 feet per minute.

An admixture of particulate substances naturally possessing or ground to a mesh size of about −30 to −250 (U.S. Standard) from feeding means indicated as 6 is introduced into entry tube 21 from which it is carried by the conveying gas into section 7 of drying duct 5. Generally speaking most natural substances with component specific gravity differences can be satisfactorily beneficiated by the apparatus and method of the invention after reduction of the particle size to minus 50 mesh which produces a size consisting of at least 60% minus 100 mesh and 30% minus 200 mesh. Any of the conventional pulverizing equipment such as ball mills, rod mills, attrition mills and the like can be used for this purpose.

The feed is made up of at least a heavy weight component, a middle weight component and a light weight component. For purposes of this description it will be assumed to be bituminous coal. Bituminous coal is chiefly comprised of iron pyrite particles and heavy ash (heavy weight component), coal particles (middle weight component) and light ash particles (light weight component). It is to be understood, however, that the invention is capable of efficiently separating any multicomponent containing natural substances whose components have specific gravity differences from one another of at least about 10%.

The temperature of the hot conveying gas will vary depending upon the length of elongated drying duct and usually falls in the range of about 300° to 1000° F. The critical factor in this regard in that the heating time and temperature employed must be sufficient to remove the surface moisture from the particles. It has been found that as material is reduced in size the inherent moisture of the particles becomes surface moisture which, unless removed, acts as a binder and tends to inhibit separation. As a general rule, any heating operation which reduces the inherent moisture of the particles by at least 50% will effectively remove the surface moisture of the particles. This can vary depending upon the particular type of coal particles being treated since their inherent moisture contents can differ significantly. For example, the inherent moisture contents for the listed coal range as follows:

| Coal | Moisture % |
|---|---|
| Anthracite | 1.0–2.3 |
| Bituminous | 2.6–12.4 |
| Subbituminous | 16.3–24.6 |
| Lignite | 30.–50. |

In all instances, however, reducing the moisture content of these coal materials by at least 50%, preferably at least 75% by weight, will assure complete removal of surface moisture from the particles.

The solids to heated conveying gas loading is maintained within a range which under the flow rate enables production of a laminar flow in curved section 9 of drying duct 5 and particularly in the elbow-shaped duct 25 of separation stage I. Ordinarily, a loading of about 1 to 5 grams per cubic foot, preferably 1.5 to 2.5 grams per cubic foot provide the desired laminar flow in these sections of the closed system rather than a uniformly dispersed particle pattern. Under these conditions when the conveying gas and particles reached curved section 9 of duct 5 there is initiated a laminar flow wherein the heavier and larger particles travel at a slower rate than the medium weight and lighter weight particles and are positioned in a different segment of the duct. At a point in drying duct 5 where sufficient solids travel ensures particle dryness, a change in direction of 120 to 140 degrees, preferably about 135 degrees in duct configuration is made to provide elbow-shaped duct 25. In elbow-shaped duct 25 a centripetal force is created whereby the lighter weight and smaller particles tend to take the shorter duct segment path around the duct bend while the heavy weight and larger particles tend to gravitate toward the outer duct segment path. An adjustable splitting means such as a deflector blade 27 is provided within the elbow-shaped duct 25 near the end of its elbow configuration which serves to select and divert the desired heavy weight particles in conveying gas into primary reject duct 29. Actually the heavy weight particles diverted are virtually dropping into the reject duct 29 and are thereby removed from the system. The main conveying circuit negative pressure at the elbow-shaped duct is preferably about 23 inches water gauge while the negative pressure at the primary reject duct 29 is about 7–10 inches water gauge. A window 31 is provided elbow-shaped duct 25 in order to view the separation effected and to otherwise assist in the control of the splitting action effected at the stage I separation. An adjustable air inlet means 33 is provided the elbow-shaped duct 25 through which additional air may be introduced in order to control the degree of centripetal force generated at this separation stage.

The heavy weight particles separated are passed down primary reject duct 29 and dropped into an entry duct 35 which passes the particles into a cyclone separator 37. In cyclone separator 37, the heavy weight particles, in this case pyritic sulfur, are collected at the bottom of the cyclone as underflow and ultrafine particles of the heavy weight material are passed over head into over head duct 39 that passes the ultrafine particles into dust collector 17.

The middle weight and light weight particles not separated in stage I continue through duct 11 and are passed into a second elbow-shaped duct wherein a centripetal force is generated to affect a laminar segmentation of the middle weight particles from the light weight particles. The elbow-shaped duct 41 in stage II separation is provided with an adjustable splitter means such as deflector 43 which splits off the middle weight solids in conveying air and diverts it into a collecting portion 45. (See FIG. 3). Furthermore, the elbow-shape duct 41 is provided with a moveable deflector means such as a deflector blade 46 for increasing or decreasing the tangential force and thereby controlling the centripetal force being induced on the admixture of particles moving through the elbow-shaped duct 41. The middle weight particles collected in collector portion 45 in this case would be the coal particles.

The light weight solids which are not diverted into collector portion 45 continue on into a circular duct 47 wherein a centripetal force in induced to separate any medium weight particles not separated in the elbow-shaped duct 41. An adjustable separating means such as a deflector 49 is provided the circular duct 47 to assist in the diversion of any such middle weight particles into the outlet path of the elbow-shaped duct 41 for passage into collector 45. A viewing window 1 is provided the stage II separation which includes both the elbow-shaped duct 41 and the circular duct 47 for assisting in the control of the separations affected in this stage.

Light weight material from the stage II separation is passed via duct 13 into a conventional cyclone separator 51. In cyclone separator 51 any middle weight small particles remaining in the particles passed to cyclone separator 51 are collected at the bottom of the separator as underflow and the light weight material, in this case ash, is passed as overflow via duct 53 into dust collector 17. The cyclone separator 51 is provided with a rotary valve unloader 55 for the recovery of the material (See FIG. 4).

If desired the medium weight particles such as coal or the light weight particles such as ash can be agglomerated and shaped utilizing any of the conventional agglomeration techniques known in the art. Particularly preferred agglomeration is described in U.S. Pat. No. 3,977,892, and hereby incorporated by reference. According to this agglomeration procedure, the solid finely divided particles are agglomerated and shaped by preheating the particles to an elevated temperature preferably a temperature to about 150° to 170° F., separately preheating a binder solution comprising a saturated dendritic crystal-forming aqueous sodium chloride solution to an elevated temperature below the temperature of the preheated particles, thoroughly mixing the preheated particles and the preheated binder solution in a ratio of about 10–20 grams of particles per milliliter of binder solution, shaping the resulting mixture under pressure and cooling the shaped mixture to recrystallize said binder solution and provide the aggregate.

The intimate mixing of the binder solution and the recovered particles can be effected by any convenient method known in the art including stirring by hand but preferably a suitable mechanical mixer indicated diagrammatically in FIG. 1 as 55. The mixture of brine and particles are then unloaded into a secondary dryer 57 to saturate the binder which is preferably an aqueous solution of mineral rock salt. When saturated the mixture is then shaped preferably by briquetting in a briquetter 59. Upon shaping, the shaped product is permitted to cool for a time sufficient to complete the recrystallization of the sodium chloride binder into dendritic crystals. Ordinarily, the recrystallization is completed in a matter of minutes, generally about 10 to 20 minutes. At this point, however, the shaped article may be somewhat plastic and should be further cooled to complete the recrystallization cycle.

Due to the small particle size of the coal particles recoverable by the method of the present invention, the method enables the efficient containment of Sulfur present in the recovered coal particles by mixing them with a stoichiometric excess of alkaline earth metal hydroxide particles, preferably calcium hydroxide particles, based on the sulfur content of the coal. Preferably about 2 to 3 parts per part of coal sulfur content by weight is used in the intimate mixture. By intimately mixing the alkaline earth metal hydroxide particles with the fine coal particles subsequent temperature elevation to and beyond to 212° F. evaporates the water of crystallization and at 240° F. the sulfur starts to melt, releasing sulfur dioxide which then combines with the alkaline metal such as calcium at approximately to 262° F. to form alkaline metal sulphate such as calcium sulphate. It is important to ensure that in the intimate mixing that the alkaline metal hydroxide particles are closely sized to those of carbon particles with which they are admixed. This feature together with the rapid elevation of temperature during combustion renders the absorption process of this invention dissimilar to that wherein ground limestone or dolomite are employed. In the latter case, the reaction takes place at a minimum of 400° F. and due to differences in substance particle size, the reaction is not nearly as efficient. The result is that instead of 2.2 pounds of absorbent, 7.1 pounds of absorbent per pound of coal content sulfur are needed for $SO_2$ emission obviation, or three times the additive effect. In terms of one ton of coal with 3.5% sulfur content, 830 pounds of ground limestone or dolomite would be needed to produce compliance $SO_2$ emissions (calculated from Keystone Coal Industry Manual, 1971, page 206). The above described process would necessitate the addition of 260 pounds of calcium hydroxide to produce coal with compliance sulfur dioxide emissions.

Similarly, the ash component recovered by the method of the invention can be shaped and briquetted in the manner described above with reference to the recovered coal particles. In this instance, the ash particles would be fed through line 19 to mixer 35, mixed, dried to saturate the brine, and briquetted as described above.

The following examples are included to further illustrate the present invention but are not to be considered as limiting same.

EXAMPLE I

The bituminous coal samples identified below were all ground to −50 mesh (U.S. Standard) and subjected to the three stage beneficiation process described above employing the apparatus of the invention. In each case: air was used as the conveying gas heated to a temperature of 350° F.; a vacuum of 23 inches water gauge was applied to pull the air through the system; the loading of particles to air was 2 grams/cubic foot; the air velocity through the apparatus measured approximately 4500 feet per minute; and the 6 inch drying duct from entry of the coal particles to the first elbow-shaped (135°) duct measured approximately 20 feet.

The first three coal samples treated were analyzed for moisture and ash content and BTUs produced while the second three coal samples were analyzed for pyritic sulfur and organic sulfur. The results are reported in the following Table I:

TABLE I

| | As Received % | Processed % |
|---|---|---|
| Bituminous Coal - Ash Pittsburgh Seam. Wash water sludge (from abandoned impoundment). Clarksburg, West Virginia. | | |
| Moisture | 10.56 (Air Dried) | 1.57 |
| Ash | 20.99 | 13.02 |
| Btu | 10,751 | 12,746 |
| Total Run/100# less 10.56 $H_2O$ = 90# Coal | | |
| Recovery/63# at 13% Ash = (70%) | | |
| Reject/27# at 40% Ash = (30%) | | |
| Pocahontas #3 Coal. McDowell County, West Virginia. Dried Water Cyclone Product. ("Deep cleaned coal") | | |
| Moisture | .94 | .75 |
| Ash | 14.92 | 10.98 |
| Btu | 13,009 | 13,581 |
| Total Run/100# less 1# $H_2O$ = 99# Coal | | |
| Recovery/80# at 10.98% Ash = (80%) | | |
| Reject/19# at 33% Ash = (20%) | | |
| Cherokee Seam. Ames, Iowa. Dense Media Vessel Cleaned and Dried Product | | |
| Moisture | 6.36 | 3.09 |
| Ash | 16.39 | 13.05 |
| Btu | 11,982 | 12,985 |
| Total Run/100# less 3.09 $H_2O$ = 97# Coal | | |
| Recovery/73# 13.05% Ash = (75%) | | |
| Reject/24# 23,5% Ash = (25%) | | |
| Bituminous Coal - Pyritic Sulfur and Organic Sulfur Kittanning Seam. Clarion County, Pennsylvania. Mine Run | | |
| Pyritic Sulfur | 2.75 | 1.00 |
| Organic Sulfur | 1.38 | 1.38 |
| Total Sulfur | 4.13 | 2.38 |
| Pyritic Sulfur Removal/62% | | |
| Total Sulfur Removal/42% | | |
| Clarion Seam. Clarion County, Pennsylvania. Mine Run | | |
| Pyritic Sulfur | 2.72 | 1.03 |
| Organic Sulfur | 1.36 | 1.36 |
| Total Sulfur | 4.08 | 2.39 |
| Pyritic Sulfur Removal/62% | | |
| Total Sulfur Removal/41% | | |
| Cherokee Seam. Ames, Iowa. Dense Media Product | | |
| Pyritic Sulfur | 1.38 | .46 |
| Organic Sulfur | 1.39 | 1.39 |
| Total Sulfur | 2.77 | 1.85 |
| Pyritic Sulfur Removal/66% | | |

TABLE I-continued

| | As Received % | Processed % |
|---|---|---|
| Total Sulfur Removal/34% | | |

EXAMPLE II

The blend of bituminous coals identified below were subjected to the beneficiation process described in Example I. The results are set forth in the following Table II:

TABLE II

| Sample ID | Original Sulfur % Converted To Ash | Original Sulfur % Available As $SO_2$ | Additional Ash % Generation | Additional Ash % Generation For 1% Sulfur Conversion To Ash |
|---|---|---|---|---|
| Stewart "A" A Blend Of Three Different Clarion Cty, Penna., Coal Seams A/R Ash: 12.74% A/R Sulfur: 5.60% | | | | |
| UNTREATED | .38 | 5.22 | — | — |
| PF* 1 | 1.87 | 3.73 | 8.5 | 4.55 |
| PF 3 | 3.67 | 1.93 | 19.20 | 5.24 |
| PF 5 | 4.74 | .86 | 24.88 | 5.25 |
| PF 7 | 5.23 | .37 | 27.24 | 5.23 |
| Stewart "B" A Triple Blend Of Dissimilar From "A" Clarion Cty, Penna., Coal Seams A/R Ash: 15.17% A/R Sulfur: 6.04% | | | | |
| UNTREATED | .36 | 5.68 | — | — |
| PF 2 | 3.49 | 2.55 | 14.14 | 4.05 |
| PF 4 | 4.59 | 1.45 | 21.15 | 4.60 |
| PF 6 | 5.54 | .50 | 24.64 | 4.45 |

*PF = Process Factor

EXAMPLE III

Coal particles recovered in Example I from the Kittaning seam were mixed with −50 mesh calcium hydroxide particles in a weight ratio of 2.24 parts calcium hydroxide per part of coal Sulfur content by weight, and intimately mixed in a mechanical mixer with an aqueous NaCl binder and unloaded in a secondary dryer where the binder was saturated at 180° F. The mixture was then introduced at about 170° F. into a K. R. Komarek briquetting machine and briquetted at a pressure of 24,000 lbs. per lineal nip inch. The resulting $1\frac{1}{2}''$ long, $\frac{3}{4}''$ thick $\times \frac{7}{8}''$ wide briquetted product was cooled to provide recrystallization.

The briquetted product was found upon combustion to meet current $SO_2$ emission standards.

It is claimed:

1. A method for separating heavy weight, middle weight and light weight solid particles from an admixture of solid particulate substances containing same which comprises (i) heating and drawing a conveying gas through a closed separation system comprising a series of three separation stages all in communication with each other;

(ii) prior to said first separation stage, contacting said heated conveying gas with said admixture with solid particulate substances having a mesh size of minus 30 to minus 250 and introducing said conveying gas and admixture of solid particulate substances into an elongated vertical heating duct having a curved section at the upper end so as to remove surface moisture from said particulate substances;

(iii) drawing said heated conveying gas with said dried admixture of particles through the curved section of said elongated heating duct at a flow rate and a solids to heated conveying gas loading that produces a laminar flow wherein heavy weight particles are positioned as a lamina in a different segment of the duct than the remaining middle weight and light weight particles by centripetal force induced therein;

(iv) drawing the laminar flow of particles through said first separation stage where the dried particles are passed through a first elbow-shaped duct;

(v) splitting away said heavy particle lamina from said remaining middle and light weight particle laminae by a first adjustable splitting means comprising a movable deflector positioned within said elbow-shaped duct;

(vi) drawing additional air into said first elbow-shaped duct via an adjustable air inlet means located ahead of said splitting means for controlling the degree of centripetal force generated at the first separation stage;

(vii) drawing the remaining middle and light weight particles to said second separation stage where the particles are passed through a second elbow-shaped duct to produce a laminar flow wherein middle weight particles are to be separated from the remaining particles positioned as laminae in different segments of the duct by centripetal force induced therein;

(viii) splitting away some of said middle weight particles as a lamina by a second adjustable splitting means comprising a movable deflector positioned within said second duct;

(xi) drawing the remaining middle and light weight particles into a circular duct wherein a centripetal force is induced to create a lamina of middle weight particles not separated in step (vii);

(x) splitting away more of the middle weight particles in the lamina created in step (ix) by a third adjustable splitting means comprising a movable deflector position within said circular duct; and (xi) drawing the remaining particles to said third separation stage comprising a cyclone separator wherein light weight particles are separated as a cyclone overflow from remaining middle weight particles separated as a cyclone underflow.

2. A method according to claim 1 wherein the conveying gas is air.

3. A method according to claim 1 wherein the heavy weight particles split away are introduced gravimetrically into a cyclone separation circuit to collect the heavy weight particles as cyclone underflow and heavy weight fine particles as cyclone overflow, and drawing the heavy weight fine particles to a dust collector.

4. A method according to claim 1 wherein the light weight particles obtained as cyclone overflow in the third separation stage are drawn into to a dust collector.

5. A method according to claim 1 wherein in the admixture of solid particulate substances the heavy weight particles are pyritic sulfur particles, the middle weight particles are coal particles and the light weight particles are ash particles.

6. A method according to claim 5 including heating separated particles selected from the group consisting of coal particles and ash particles to a temperature of about 150° to 170° C., preheating a binder solution comprising a saturated dendritic crystal-forming aqueous sodium chloride solution to the elevated temperature of said heated particles, mixing thoroughly said preheated particles and said preheated binder solution in a ratio of about 10 to 20 grams of particles per milliter of binder solution, shaping the resulting mixture under pressure and cooling the shaped mixture to recrystallize said binder solution and provide an agglomerate.

7. A method according to claim 6 wherein the aqueous sodium chloride solution is formed of mineral rock salt.

8. A method according to claim 5 wherein the coal particles recovered are mixed with a stoichiometric excess of alkaline earth metal hydroxide particles based on the sulfur content of the coal, said particles being of substantially the same mesh size as said coal particles.

9. A method of claim 8 wherein the mixture of recovered coal particles and alkaline earth metal hydroxide particles are agglomerated.

10. A method according to claim 9 wherein the agglomeration comprises heating the mixture of recovered coal particles and alkaline earth metal hydroxide to a temperature of about 150° to 170° C., preheating a binder solution comprising a saturated dendritic crystal-forming aqueous sodium chloride solution to an elevated temperature of said heated particles, mixing thoroughly said preheated particles and said preheated binder solution in a ratio of about 10 to 20 grams of particles per millileter of binder solution, shaping the resulting mixture under pressure and cooling the shaped mixture to recrystallize said binder solution and provide said agglomerate.

11. A method according to claim 10 wherein the alkaline earth metal hydroxide is CaOH and the aqueous sodium chloride solution is formed of mineral rock salt.

12. An apparatus for separating heavy weight, middle weight and light weight solid particles from an admixture of solid particulate substance containing same which comprises (a) a closed separation system comprising a series of three interconnected separation means, (b) means for drawing a conveying gas through said closed separation system, (c) means for feeding said admixture of solid particle into said conveying gas, (d) an elongated substantially vertical heating duct for drying said admixture of solid particles to remove surface moisture therefrom, said duct having a curved section at the upper end thereof within which is produced laminar flow wherein heavy weight particles are positioned as lamina in a different segment of the duct than the remaining middle weight and light weight particles by centripetal force induced therein, (e) a first separation means comprising a first elbow-shaped duct through which said dried admixture of particles is passed from said heating duct upper end in the laminar flow and wherein heavy weight particles are separated from the remaining middle weight and light weight particles lamina are further separated from the remaining middle weight and light weight particle laminae by centripetal force induced therein, (f) an adjustable splitting means comprising a moveable deflector in said first elbow-shaped duct for splitting away said heavy particle lamina from said remaining middle weight and light weight particle lamina, (g) an adjustable air inlet means located ahead of said splitting means for controlling the degree of centripetal forces generated at said first separation means, (h) a second separation means comprising a second elbow-shaped duct and a circular duct communicating with said second elbow-shaped duct through which ducts said remaining middle weight and light weight products are successively passed in a laminar flow and separated from the remaining particles by centripetal force induced therein, (i) a second adjustable means comprising a moveable deflector in said second elbow-shaped duct for splitting away some of said middle weight particles from the remaining middle weight and the light weight particles, (j) a third adjustable splitting means in said circular duct for splitting away more of said middle weight particles from the remaining middle weight and the light weight particles, (k) a third separation means comprising a cyclone separator wherein light weight particles are separated as a cyclone overflow from the remaining middle weight particles separated as a cyclone underflow.

13. An apparatus according to claim 12 wherein said elongated duct is connected to one end of said first elbow-shaped duct, means for introducing hot air connected to said elongated duct at its other end with said means for feeding said admixture of particles near the end of said duct connected to hot air introduction means.

14. An apparatus according to claim 12 including a dust collector and a duct means connecting said dust collector with the overflow outlet of the cyclone separator.

15. An apparatus according to claim 12 including a collector means for the heavy weight particles, said collector means comprising a cyclone separator which collects coarse heavy weight particles as a cyclone underflow and heavy weight fine particles as a cyclone overflow.

16. An apparatus according to claim 15 including duct means connecting the overflow of said collector means with said dust collector.

* * * * *